US007469123B2

(12) United States Patent
Tanjo

(10) Patent No.: US 7,469,123 B2
(45) Date of Patent: Dec. 23, 2008

(54) IMAGE FORMING APPARATUS

(75) Inventor: Toru Tanjo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 351 days.

(21) Appl. No.: 11/239,670

(22) Filed: Sep. 28, 2005

(65) Prior Publication Data

US 2006/0067761 A1 Mar. 30, 2006

(30) Foreign Application Priority Data

Sep. 29, 2004 (JP) ..... P2004-283949

(51) Int. Cl.
*G03G 15/00* (2006.01)

(52) U.S. Cl. ..... 399/396; 399/388; 399/401

(58) Field of Classification Search ..... 399/388, 399/396, 401
See application file for complete search history.

(56) References Cited

U.S. PATENT DOCUMENTS 6,450,711 B1 9/2002 Conrow

FOREIGN PATENT DOCUMENTS

| | | |
|---|---|---|
| JP | 58-178373 | 10/1983 |
| JP | 09-006206 | 1/1997 |
| JP | 2000-128442 | 5/2000 |
| JP | 2003-050528 | 2/2003 |

*Primary Examiner*—Ren Yan
*Assistant Examiner*—Andy L Pham
(74) *Attorney, Agent, or Firm*—Hogan & Hartson LLP

(57) ABSTRACT

An image forming apparatus includes an image forming portion that superposes images on an intermediate transfer member by rotations of the intermediate transfer member to form a color image on the intermediate transfer member, a transfer portion that transfers the image formed on the intermediate transfer member in the image forming portion to a sheet, a fixing portion that fixes the image onto the sheet, and a switchback portion that switches back the sheet so as to return the sheet to the transfer portion for forming the image on a second face of the sheet, after the image has been formed on a first face of the sheet. The sheet is returned through a return path at a return speed equal to or lower than a delivery speed of the sheet in the transfer portion, when the image for the second face of the sheet is the color image.

2 Claims, 4 Drawing Sheets

IMAGE FORMING APPARATUS

BACKGROUND OF THE INVENTION

The present invention relates to an image forming apparatus capable of forming a monochrome (monochromatic) image or a color image on both sides of a paper (a plain paper, a cardboard, a postcard, an envelope, an OHP sheet or other sheet-shaped recording media). In particular, the invention relates to a technique regarding the return speed of a paper in the case that images are formed on both sides of the paper.

Recently, there has been known an image forming apparatus capable of forming a monochrome or color image on both sides of a paper in which all of the delivery speeds of the paper are increased more greatly except for the time of the transfer of an image to the paper as compared with the delivery speed of the paper in the formation of an image or the transfer of the image to the paper (for example, see JP-A-2003-50528).

In an image forming apparatus including an image forming portion for forming an image having one color on an intermediate transfer member per rotation of the intermediate transfer member or superposing images having a plurality of colors on the intermediate transfer member by a plurality of rotations of the intermediate transfer member, thereby forming a color image on the intermediate transfer member, a transfer portion for transferring the image formed on the intermediate transfer member in the image forming portion to a paper, and a fixing portion for causing the paper having the image transferred in the transfer portion to pass therethrough, thereby fixing the image onto the paper, in which the paper passing through the fixing portion can be switched back toward a return path and can be thus returned to the transfer portion so that the image can also be transferred to the other surface of the paper, a paper return speed in the formation of a color image is also increased if all of the delivery speeds of the paper except for the time of the transfer of the image are increased as in the prior art described above.

For this reason, there is a problem in that a noise made by the high-speed return is increased.

SUMMARY OF THE INVENTION

It is an object of the invention to provide an image forming apparatus capable of reducing a noise in the formation of a color image.

In order to achieve the above object, according to the present invention, there is provided an image forming apparatus, comprising:

an image forming portion that superposes images having a plurality of colors on an intermediate transfer member by a plurality of rotations of the intermediate transfer member to form a color image on the intermediate transfer member;

a transfer portion that transfers the image formed on the intermediate transfer member to a sheet;

a fixing portion that fixes the transferred image onto the sheet; and a switchback portion that switches back the sheet that has passed through the fixing portion so as to return the sheet to the transfer portion through a return path for forming the image on a second face of the sheet, after the image has been formed on a first face of the sheet, wherein the sheet is returned through the return path at a return speed equal to or lower than a delivery speed of the sheet at the transfer in the transfer portion when the image formed in the image forming portion for the second face of the sheet is the color image.

Preferably, the image forming portion forms an image having one color on the intermediate transfer member per rotation of the intermediate transfer member. The sheet is returned through the return path at a return speed greater than the delivery speed of the sheet at the transfer in the transfer portion when the image formed in the image forming portion for the second face of the sheet is a one color image.

In the above configuration, when the image to be formed in the image forming portion for the second face of the sheet is a color image, the sheet is returned at a low speed which is equal to or lower than the delivery speed in the transfer. Therefore, a noise made by returning the sheet can be reduced.

More specifically, in an image forming apparatus having such a structure as to form the image having one color on the intermediate transfer member per rotation of the intermediate transfer member in the formation of a color image and to superpose images having a plurality of colors on the intermediate transfer member by a plurality of rotations of the intermediate transfer member, thereby forming color images on the intermediate transfer member, and to transfer the color images to the sheet in a lump in the transfer portion, even if the sheet is returned at a high speed, the image cannot be transferred before the superposition of the color image is completed. For this reason, the return at an unnecessarily high speed is useless, resulting in an increase in a noise.

On the other hand, according to the image forming apparatus in accordance with the invention, when a color image is formed in the image forming portion for the second face of the sheet, the sheet is returned at a low speed which is equal to or less than the delivery speed in the transfer. Consequently, it is possible to reduce a noise which is made by the return of the sheet.

Preferably, when the image formed in the image forming portion for the second face of the sheet is the color image, the return speed of the sheet is set to be equal to a speed at which a tip of the sheet in a deliver direction of the sheet reaches the transfer portion at the transferring timing in which the color image is transferred to the second face of the sheet in the transfer portion.

In the above configuration, it is possible to prevent the number of sheets on which the image is formed per unit time from being reduced in the formation of a color image on both surfaces of the sheet.

On the other hand, when the image to be formed in the image forming portion for the second face of the sheet is a monochrome image (the one image), the sheet is returned at a higher speed than the delivery speed in the transfer. Consequently, it is possible to increase the number of the sheets on which the monochrome image is formed per unit time.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An embodiment of an image forming apparatus according to the invention will be described below with reference to the drawings.

Figure 1:
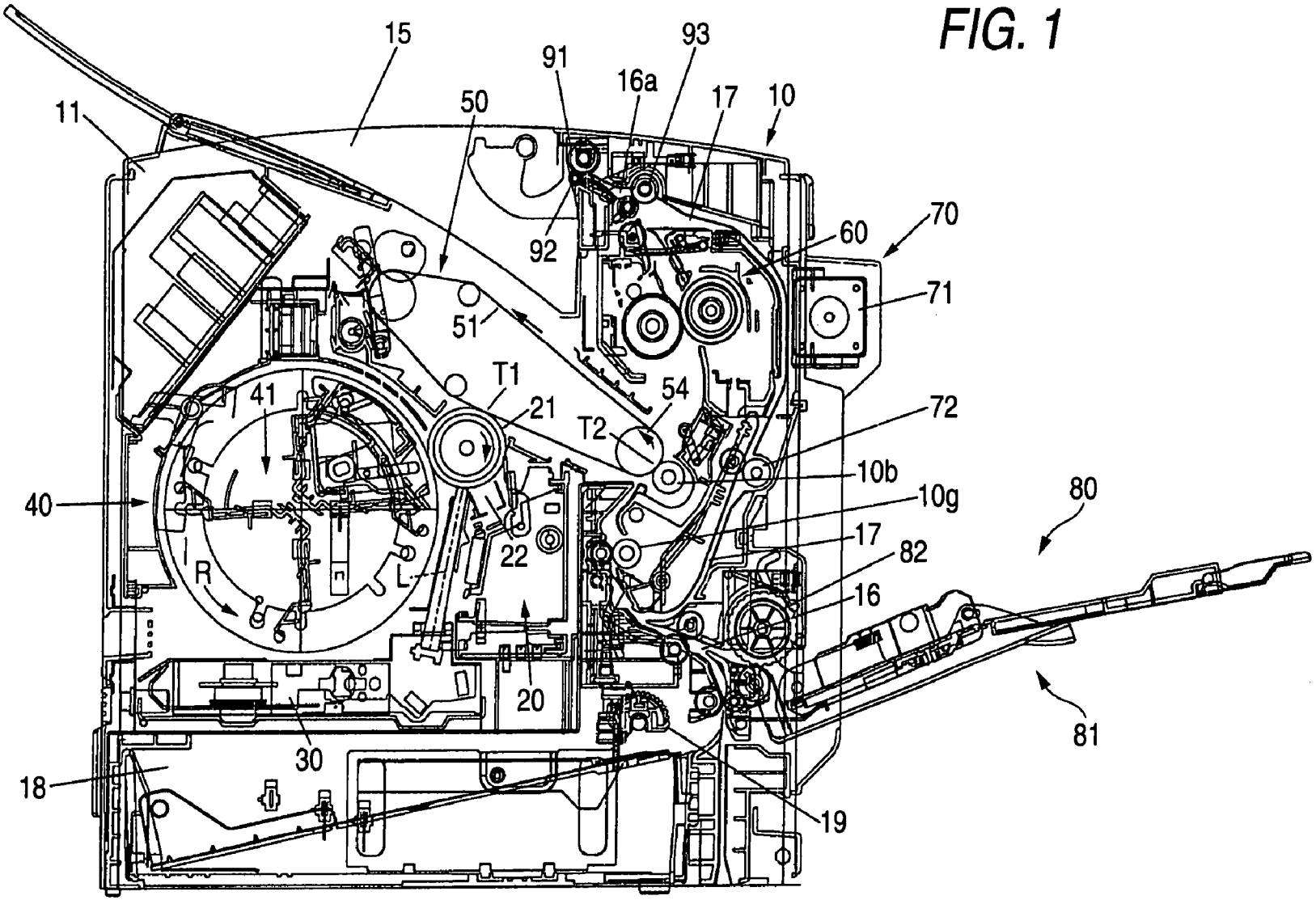
FIG. 1 is a schematic front view showing an internal structure of an image forming apparatus according to an embodiment of the invention.

FIG. 1 is a schematic front view showing an internal structure of the image forming apparatus according to the embodiment of the invention.

The image forming apparatus can send a paper having an A4 size (including a letter size) longitudinally to form a monochrome (monochromatic) image or a full color image on both sides thereof, and includes a case 11, an image carrier unit 20 accommodated in the case 11 and constituting an image forming portion, an exposing unit 30, and a developing unit (a developing device) 40. Moreover, the image forming apparatus includes an intermediate transfer unit 50 and a fixing unit (fixing portion) 60.

The case 11 is provided with a frame (not shown) in an apparatus body 10, and each unit is attached to the frame.

The image carrier unit 20 includes a photosensitive member 21 having a photosensitive layer on an outer peripheral surface, and a corona charger (a scorotron charger) 22 serving as a charging unit for uniformly charging the outer peripheral surface of the photosensitive member 21, and the outer peripheral surface of the photosensitive member 21 which is uniformly charged by the corona charger 22 is selectively exposed by a laser beam L emitted from the exposing unit 30 to form an electrostatic latent image and a toner to be a developer is applied to the electrostatic latent image by means of the developing unit 40 to form a visible image (a toner image), and the toner image is a primarily transferred in a primary transfer portion T1 an intermediate transfer belt 51 serving as the intermediate transfer member of the intermediate transfer unit 50, and furthermore, is secondarily transferred to the paper serving as a transfer object in a secondary transfer portion (transfer portion) T2.

The case 11 includes a delivery path 16 for delivering the paper having an image formed on either side by the secondary transfer portion T2 toward a paper discharge portion (a paper discharge tray) 15 on the upper surface of the case 11, and a return path 17 for switching back the paper delivered toward the paper discharge portion 15 through the delivery path 16 and returning the paper toward the secondary transfer portion T2 in order to form an image on the other surface.

70 denotes a double-sided unit which is constituted to be freely attached to or removed from an apparatus body, and the double-sided unit 70 is attached so that the return path 17 is finished.

71 denotes a driving motor for returning a paper, and 72 denotes a paper return roller to be driven by the motor 71 through a driving mechanism (not shown) such as a timing belt.

A paper feed cassette 18 for laminating and holding a plurality of papers is provided in the lower part of the case 11, and a paper feed roller 19 for feeding the papers one by one toward the secondary transfer portion T2 is provided.

A multipurpose tray 81 constituting a manual paper feed portion 80 is provided below the double-sided unit 70, and the apparatus body is provided with a paper feed roller 82 for feeding the papers set into the multipurpose tray 81 one by one.

The developing unit 40 is a rotary developing unit (a rotary developing device) and developing unit cartridges (not shown) for colors which accommodate a yellow toner, a cyan toner, a magenta toner and a black toner are removably attached to a rotor body 41. When the rotor body 41 is rotated at a pitch of 90 degrees in a direction of an arrow R, a developing roller (not shown) provided in each of the developing unit cartridges is selectively caused to abut on the photosensitive member 21 so that the surface of the photosensitive member 21 can be developed selectively.

The exposing unit 30 irradiates the laser beam L toward the photosensitive member 21.

The intermediate transfer unit 50 includes a unit frame which is not shown, and the intermediate transfer belt 51 to be an intermediate transfer member wound around and stretched over a driving roller 54 supported rotatably on the frame and a plurality of driven rollers, and the intermediate transfer belt 51 is circulated and driven in the direction of an arrow in the drawing. The primary transfer portion T1 is formed in the abutment part of the photosensitive member 21 and the intermediate transfer belt 51, and the secondary transfer portion T2 is formed in the pressure contact part of the driving roller and a secondary transfer roller 10*b* provided on the body side.

The secondary transfer roller 10*b* can approach and separate from the driving roller 54 (accordingly, the intermediate transfer belt 51), and the secondary transfer portion T2 is formed at time of a contact.

When a color image is to be formed, therefore, an image having one color is formed on the intermediate transfer belt 51 per rotation of the intermediate transfer belt 51 and images having a plurality of colors are superposed on the intermediate transfer belt 51 by a plurality of rotations of the intermediate transfer belt 51 so that a color image is formed on the intermediate transfer belt 51 in a state in which the secondary transfer roller 10*b* separates from the intermediate transfer belt 51, and the secondary transfer roller 10*b* then abuts on the intermediate transfer belt 51 and the paper is supplied to the abutment part (the secondary transfer portion T2) so that a color image (a toner image) is transferred (secondarily transferred) from the intermediate transfer belt 51 onto the paper.

The paper having the toner image transferred thereto passes through the fixing unit 60 so that the toner image is fused and fixed, and the paper is discharged toward the paper discharge tray 15.

The image forming apparatus includes a pair of paper discharge rollers 91 and 92 for discharging the paper passing through the fixing portion 60 onto the paper discharge tray 15, and a pair of switchback rollers 93 provided between the fixing portion 60 and the pair of paper discharge rollers 91 and 92 and serving to switch back the paper passing through the fixing portion 60 and to return the same paper to the image forming portion constituted by the photosensitive member 21.

The pair of switchback rollers 93 are provided in a paper discharge path 16*a* disposed from the fixing portion 60 toward the pair of paper discharge rollers 91 and 92, and the pair of paper discharge rollers 91 and 92 and the pair of switchback rollers 93 are reversed to feed the paper to the return path 17 immediately before the rear end of the paper passes through the nip portion of the pair of switchback rollers 93. Thus, the paper is switched back.

The paper supplied to the return path 17 is delivered by means of the return roller 72 and is fed to the secondary transfer portion T2 through a pair of gate rollers 10*g* for determining the feed timing of the paper to the secondary transfer portion T2.

Figure 2:
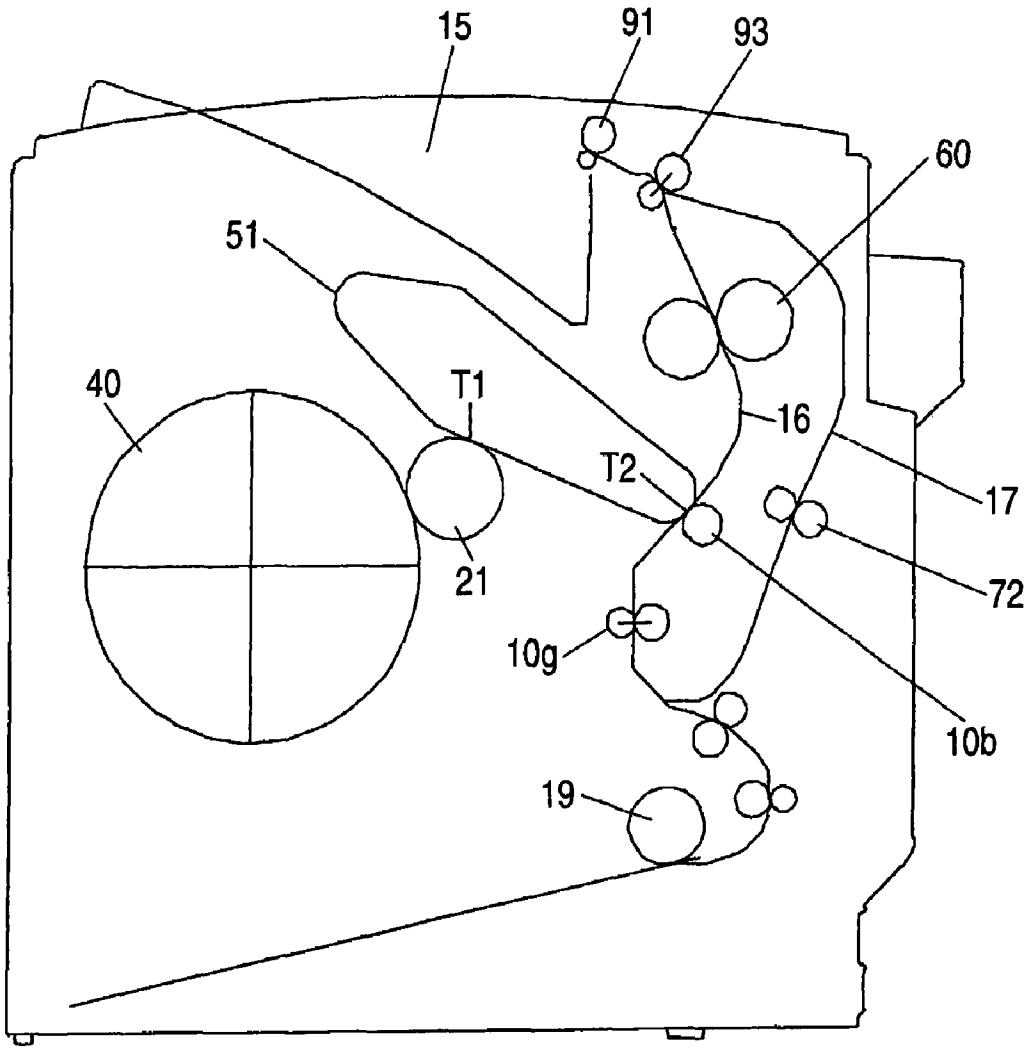
FIG. 2 is a schematic view showing the internal structure of the image forming apparatus according to the embodiment of the invention.

FIG. 2 is a schematic view showing the image forming apparatus.

In FIG. 2, the path length of the delivery path 16 from the pair of gate rollers 10*g* to the pair of switchback rollers 93 is 208 mm, and the path length of the return path 17 from the pair of switchback rollers 93 to the pair of gate rollers 10*g* is 352 mm. The length of a paper having an A4 size is 297 mm.

Figure 3:
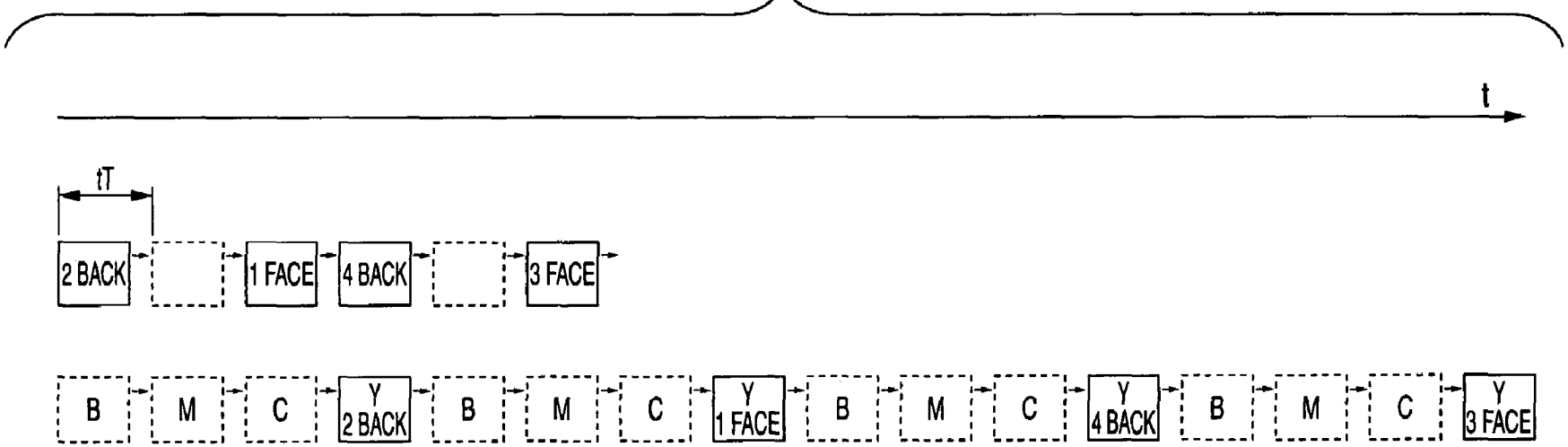
FIG. 3 is a diagram showing an image forming pattern of the image forming apparatus according to the embodiment of the invention.

FIG. 3 is a diagram showing an image forming pattern in the case that images corresponding to four pages in total are formed on the faces and backs of two papers having the A4 size. In FIG. 3, the case of a monochrome image process is illustrated in an upper stage and the case of a color image process is illustrated in a lower stage, in which an axis of abscissa indicates a time (t).

Figure 4A:
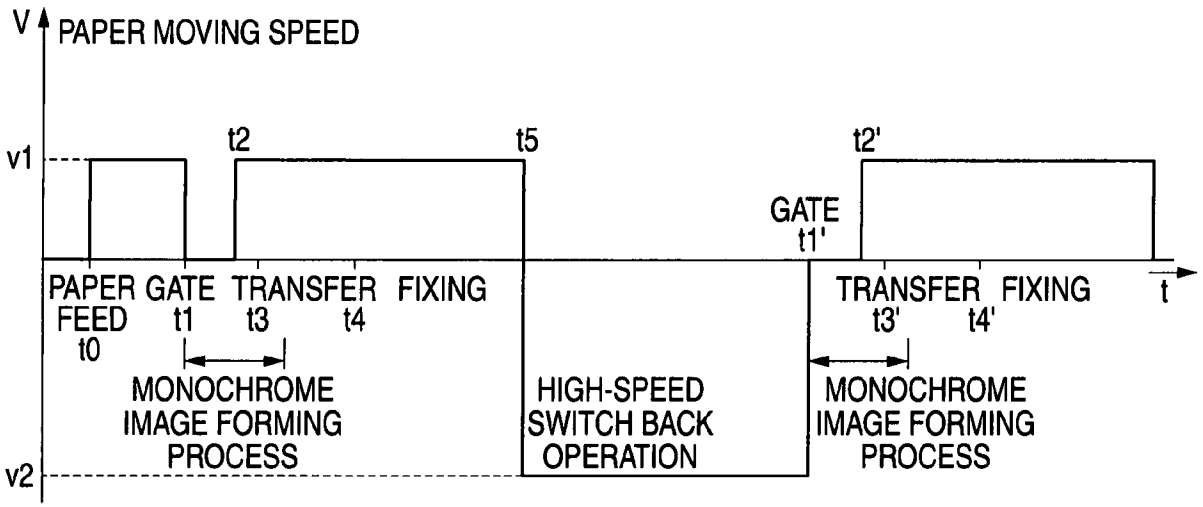
FIG. 4A is a diagram mainly showing the delivery speed of a paper in a monochrome image process.
Figure 4B:
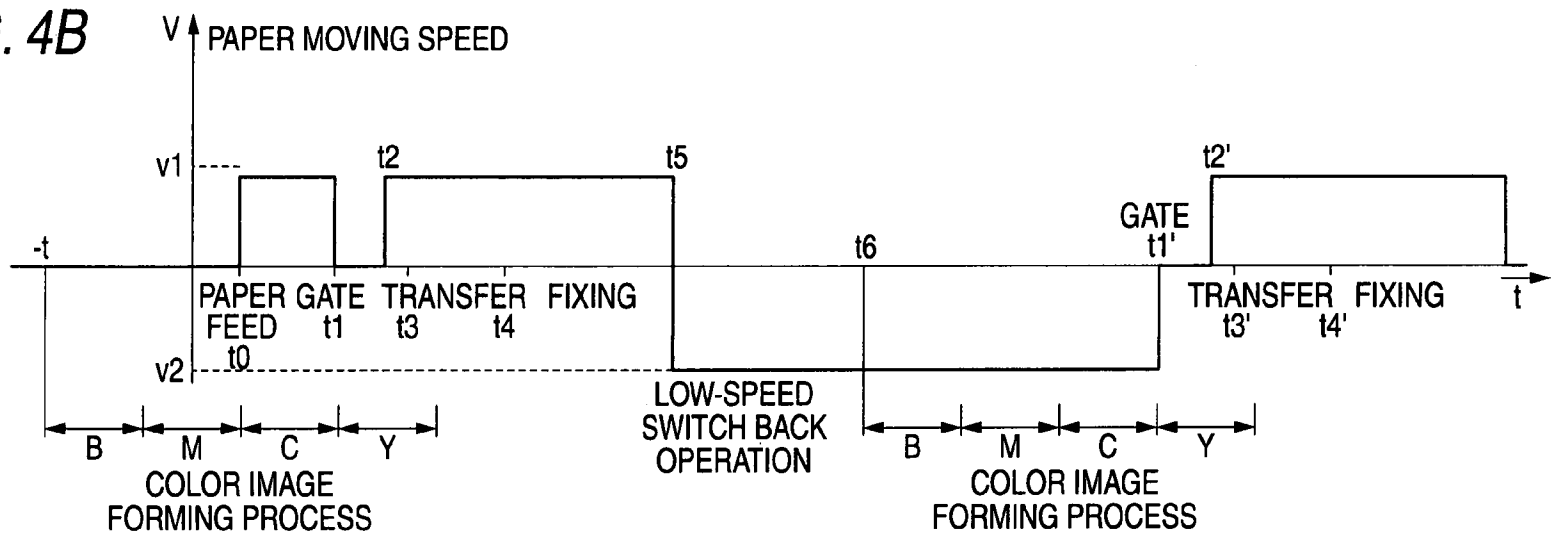
FIG. 4B is a diagram mainly showing the delivery speed of a paper in a color image process.

FIG. 4A is a diagram mainly showing the delivery speed of the paper in a monochrome image process and FIG. 4B is a diagram mainly showing the delivery speed of the paper in a color image process, in which an axis of ordinate indicates a speed (V) and an axis of abscissa indicates a time (t).

First of all, with reference to FIG. 3, description will be given to an image forming pattern in the case that images corresponding to four pages in total are formed on the faces and backs of two papers having the A4 size. In the drawing, tT indicates a time required for the intermediate transfer belt 51 to take a round. Moreover, the image forming apparatus serves to discharge a paper facedown. For this reason, the order of the formation of images on the face and back of the paper is reversed.

<Case of Monochrome Image>

In the case that monochrome image is to be formed an image of a second page ((2 back) in the drawing) for either side (a back) of a first paper is first formed on the intermediate transfer belt 51, the same image is transferred and fixed to either side of the first paper (the second page), the first paper is returned, and then, an image of a first page ((1 face) in the drawing) for the other side (a face) of the first paper is formed, the same image is transferred and fixed to the other side of the first paper (the first page), and the paper is discharged to the paper discharge tray 15.

Next, an image of a fourth page ((4 back) in the drawing) for either side (a back) of a second paper is formed on the intermediate transfer belt 51, the same image is transferred and fixed to either side of the second paper (the fourth page), the second paper is returned, and then, an image of a third page ((3 face) in the drawing) for the other side (a face) of the second paper is formed, the same image is transferred and fixed to the other side of the second paper (the third page), and the paper is discharged to the paper discharge tray 15.

<Case of Color Image>

In the case that a color image is to be formed, a black image (B), a magenta image (M), a cyan image (C), and a yellow image (Y) for either side (a back) of a first paper are first superposed on the intermediate transfer belt 51 to form an image of a second page ((Y2 back) in the drawing), and at the same time, to transfer and fix a color image obtained by superposing the four colors to either side of the first paper (the second page), and the image (B, M, C, Y) of a first page for the other side (a face) of the first paper is formed while the first paper is returned, and the image ((Y1 face) in the drawing) is transferred and fixed to the other side of the first paper (the first page) and the paper is discharged to the paper discharge tray 15.

Subsequently, an image (B, M, C, Y) of a fourth page for either side (a back) of a second paper is formed on the intermediate transfer belt 51, the image ((Y4 back) in the drawing) is transferred and fixed to either side (the fourth page) of the second paper, and the image (B, M, C, Y) of a third page for the other side (a face) of the second paper is formed while the second paper is returned, and the image ((Y3 face) in the drawing) is transferred and fixed to the other surface of the second paper (a third page) and the paper is discharged to the paper discharge tray 15.

FIGS. 4A and 4B show a relationship between the image forming pattern and a paper delivery speed.

<Case of Monochrome Image (FIG. 4A)>

In the case that a monochrome image is formed, a feeding of a paper is started at a speed v1 at a time t0, and the delivery of the paper is once stopped when the tip of the paper reaches the pair of gate rollers 10*g* (t1), and at the same time, the image of the second page for the either side (the back) of the first paper is started to be formed on the intermediate transfer belt 51.

Then, the delivery of the paper is started at the speed v1 in a predetermined timing t2 and a transfer to either side of the paper (the second page) is started at a time t3, and a fixation is started at a time t4.

Thereafter, the pair of switchback rollers 93 are reversed at (or immediately before) a time t5 that the rear end of the paper reaches the nip portion of the pair of switchback rollers 93, the paper is returned at a higher speed v2 than the speed v1, and the delivery of the paper is once stopped, and at the same time, the image of the first page for the other side (the face) of the paper is started to be formed on the intermediate transfer belt 51 at a time (t1') that the rear end of the paper (a tip in a return direction) reaches the pair of gate rollers 10*g*.

Subsequently, the delivery of the paper is started at the speed v1 in a predetermined timing t2', a transfer to the face (the first page) of the paper is started at a time t3' and a fixation is started at a time t4', and the paper is discharged to the paper discharge tray 15.

In the case that the monochrome image is also formed on the second paper and succeeding papers, the same operation is repeated.

<Case of Color Image (FIG. 4B)>

In the case that a color image is formed, an image (B, M, C, Y) of a second page for either side (a back) of a first paper is started to be formed on the intermediate transfer belt 51 at a time −t. Then, the paper is started to be fed at a speed v1 at a time t0, and the delivery of the paper is once stopped at a time (t1) that the tip of the paper reaches the pair of gate rollers 10*g*, the delivery of the paper is started at the speed v1 in a predetermined timing t2, a transfer to either side (the second page) of the paper is started at a time t3, and a fixation is started at a time t4.

Thereafter, the pair of switchback rollers 93 are reversed at (or immediately before) a time t5 that the rear end of the paper reaches the nip portion of the pair of switchback rollers 93, the paper is returned at a low speed v2 which is equal to or less than the speed v1 (in the embodiment, v2 is equal to the delivery speed v1), and the image (B, M, C, Y) of a first page for the other side (the face) of the first paper is started to be formed on the intermediate transfer belt 51 in a predetermined timing t6.

Subsequently, the delivery of the paper is once stopped at a time (t1') that the rear end of the paper to be returned (a tip in a return direction) reaches the pair of gate rollers 10*g*, the delivery of the paper is started at the speed v1 in a predetermined timing t2', a transfer to the surface (the first page) of the paper is started at a time t3', a fixation is started at a time t4', and the paper is discharged to the paper discharge tray 15.

In the case that the color image is to be also formed on a second paper and succeeding papers, the same operation is repeated.

As is apparent from FIG. 4B, similarly, when an image to be formed in the image forming portion for the other surface of the paper is a color image, the return speed v2 of the paper is equal to a speed at which the tip in the delivery direction of the paper reaches the transfer portion at the time t3' that the color image is transferred to the other surface of the paper in the transfer portion (secondary transfer portion) T2.

In the case that the monochrome image and the color image are formed on the face and back of a paper, FIGS. 4A and 4B are combined.

The process is controlled by a control portion (not shown) which is provided in the image forming apparatus body.

The image forming apparatus described above, includes:

an image forming portion for forming an image having one color on an intermediate transfer member 51 per rotation of the intermediate transfer member 51 or superposing images having four colors on the intermediate transfer member 51 by four rotations of the intermediate transfer member 51, thereby forming a color image on the intermediate transfer member 51;

a transfer portion T2 for transferring, to a paper, the image formed on the intermediate transfer member 51 in the image forming portion; and a fixing portion 60 for fixing the image onto the paper by causing the paper having the image transferred thereto in the transfer portion T2 to pass therethrough, the paper passing through the fixing portion 60 being switched back toward a return path 17 and being returned to the transfer portion T2 so that the image can also be transferred to the other surface of the paper, wherein the paper is returned at a low speed v2 which is equal to or lower than a delivery speed v1 in the transfer when the image to be formed in the image forming portion for the other surface of the paper is a color image, and the paper is returned at a higher speed v2 than the delivery speed in the transfer when the image to be formed in the image forming portion for the other surface of the paper is a monochrome image. According to such a structure, therefore, the following functions and advantages can be obtained.

More specifically, when the image to be formed in the image forming portion for the other surface of the paper is a color image, the paper is returned at a low speed v2 which is equal to or lower than the delivery speed v1 in the transfer. Therefore, a noise made by returning the paper can be reduced.

In other words, in an image forming apparatus having such a structure as to form an image having one color on the intermediate transfer member 51 per rotation of the intermediate transfer member 51 in the formation of a color image and to superpose images having a plurality of colors on the intermediate transfer member 51 by a plurality of rotations of the intermediate transfer member 51, thereby forming color images on the intermediate transfer member 51, and to transfer the color images to the paper in a lump in the transfer portion T2, even if the paper is returned at a high speed, the image cannot be transferred before the superposition of the color image is completed (see FIGS. 4A and 4B). For this reason, the return at an unnecessarily high speed is useless, resulting in an increase in a noise.

On the other hand, according to the image forming apparatus, when a color image is formed in the image forming portion for the other surface of the paper, the paper is returned at a low speed which is equal to or lower than the delivery speed in the transfer. Consequently, it is possible to reduce a noise which is made by the return of the paper.

Moreover, the return speed v1 of the paper at this time is set to be equal to a speed at which the tip in the delivery direction of the paper reaches the transfer portion T2 in the transfer in which the color image is transferred to the other surface of the paper in the transfer portion T2. Therefore, it is possible to prevent the number of sheets on which the image is formed per unit time from being reduced in the formation of a color image on both surfaces of the paper.

On the other hand, when the image to be formed in the image forming portion for the other surface of the paper is a monochrome image, the paper is returned at a higher speed v2 than the delivery speed in the transfer. Consequently, it is possible to increase the number of the sheets on which the monochrome image is formed per unit time.

While the embodiment according to the invention has been described above, the invention is not restricted to the embodiment but modifications can be properly made without departing from the scope of the invention.

The present application is based on Japan Patent Application No. 2004-283949 filed on Sep. 29, 2004, the contents of which are incorporated herein for reference.

What is claimed is:

1. An image forming apparatus, comprising:

an intermediate transfer member;

an image forming portion adapted to form a monochrome image on the intermediate transfer member by rotating the intermediate transfer member at one time, and to superpose a plurality of monochrome images on the intermediate transfer member by rotating the intermediate transfer member at plural times to form a multi-color image on the intermediate transfer member;

a transfer portion adapted to transfer the image formed on the intermediate transfer member to a sheet delivered with a first speed;

a fixing portion adapted to fix the transferred image onto the sheet; and a switchback portion adapted to switch back the sheet that has passed through the fixing portion so as to return the sheet to the transfer portion through a return path with a second speed, for forming the image on a second face of the sheet, after the image has been fixed on a first face of the sheet, wherein:

the second speed is equal to or lower than the first speed when the image formed in the image forming portion to be transferred on the second face of the sheet is a multi-color image; and the second speed is greater than the first speed when the image formed in the image forming portion to be transferred on the second face of the sheet is a monochrome image.

2. The image forming apparatus according to claim 1, wherein when the image formed in the image forming portion to be transferred on the second face of the sheet is the multi-color image, the second speed is so set that a leading end of the sheet reaches the transfer portion at the timing at which the transfer of the multi-color image on the second face of the sheet is performed.

* * * * *